United States Patent [19]

Mabuchi et al.

[11] 4,335,318

[45] Jun. 15, 1982

[54] ENGINE-DRIVEN MODEL TOY

[75] Inventors: Kenichi Mabuchi; Tatsuo Katsunuma, both of Matsudo, Japan

[73] Assignee: Mabuchi Motor Co., Ltd., Japan

[21] Appl. No.: 135,996

[22] Filed: Mar. 31, 1980

[30] Foreign Application Priority Data

Apr. 24, 1979 [JP] Japan ..... 54-50442
May 18, 1979 [JP] Japan ..... 54-66624[U]

[51] Int. Cl.[3] ..... A63H 27/14

[52] U.S. Cl. ..... 290/31; 46/249; 123/185 D; 244/190

[58] Field of Search ..... 290/31; 123/185 D, 179 AS; 46/78; 244/190; 74/67

[56] References Cited

U.S. PATENT DOCUMENTS 1,427,301 8/1922 Kloneck .
2,466,427 4/1949 Hoover ..... 290/31
2,761,978 1/1955 Piumi ..... 290/31

*Primary Examiner*—J. D. Miller
*Assistant Examiner*—D. L. Rebsch
*Attorney, Agent, or Firm*—McGlew and Tuttle

[57] ABSTRACT

An engine-driven model toy having an engine, an electric motor connected to the engine and a power source battery, and characterized in that the electric motor, powered by the battery, drives the engine at the start of the engine while, during the continuous operation of the engine, the electric motor is driven by the revolution of the engine to charge the battery is disclosed. Also, an engine-driven model toy characterized in that the engine and the electric motor are connected through a transmission mechanism capable of changing over the engine/motor speed ratio at predetermined values in accordance with the starting and continuous operation modes of the engine is disclosed.

11 Claims, 3 Drawing Figures

ENGINE-DRIVEN MODEL TOY

BACKGROUND OF THE INVENTION

1. Field of the Invention

This invention relates generally to an engine-driven model toy, and more particularly to an engine-driven model toy having an engine; an electric motor, which is connected to the engine and has two-fold functions of an electric motor at the start of the engine and a dynamo during the continuous operation of the engine; a power source battery; a transmission mechanism capable of changing over the engine/motor speed ratio at predetermined values in accordance wth the starting and continuous operation modes of the engine; and a switching mechanism capable of switching the battery connection from series to parallel connection or vice versa in accordance with the operating modes of the motor.

2. Description of the Prior Art

In general, an engine-driven model toy, such as a model airplane, is equipped on-board with an engine as its power plant, a control unit for starting the engine or controlling the engine and the airframe, and a rechargeable Ni-Cd battery, etc. as a power source for operating them.

In the conventional type of model airplane, the engine has been started by turning the propeller by hand. This has been very cumbersome and apt to involve the danger of hand injury by the revolving propeller. To cope with this, an external engine driving means (such as an engine starter) is often provided separately to start the propeller. This, however, requires separate provision of the driving means, increasing the overall cost of the model airplane. More recently, there is an increasing tendency toward equipping onboard the model airplane an engine starter motor which is connected to the engine drive shaft via a reduction train such as gears with clutches. In this case, however, the motor becomes useless once the engine has been started, causing a loss in the engine output due to the increased weight of the airplane, though it gives no direct load to the engine as it is disengaged from the engine by the clutch. Moreover, the battery, which has been consumed for the start of the engine, will have to be charged by a separate charger as occasion demands.

On actual motorcycles, a motor for starting the engine and a generator for charging the battery are often equipped onboard separately. However, this cannot be applied to model toys because of increases in both equipment cost and weight. Particularly, provision of a generator for charging the battery in a model airplane would increase the output/weight ratio, adversely affecting the flight performance of the airplane.

SUMMARY OF THE INVENTION

It is an object of this invention to provide an engine-driven model toy having an electric motor which is used as a motor to start the engine of the model toy by receiving the power of the built-in battery at the start of the engine and as a generator to charge the battery by receiving the revolution of the engine during the continuous operation of the engine.

It is another object of this invention to provide an engine-driven model toy having a transmission mechanism capable of changing over the rotational speed ratio of the engine to the motor at the start of the engine and during the operation of the engine at the respective predetermined values.

It is still another object of this invention to provide an engine-driven model toy which permits the use of a single output shaft engine to reduce manufacturing costs by arranging two clutches coaxially, for example, for changing over the coupling gear ratio of the engine to the motor in the transmission mechanism.

It is a further object of this invention to provide an engine-driven model toy having electric circuitry including a switching circuit capable of switching the power source battery to a series connection at the start of the engine to provide a larger torque, and to a parallel connection during the operation of the engine to charge the battery.

It is still a further object of this invention to provide an engine-driven model toy having a voltage regulator in the electric circuitry for controlling a high voltage produced by the high-speed revolution of the engine to a predetermined voltage value.

The above and further objects and novel features of the present invention will more fully appear from the following detailed description when the same is read in connection with the accompanying drawings. It is to be expressly understood, however, that the drawings are for purpose of illustration only and are not intended as a definition of the limits of the present invention.

DETAILED DESCRIPTION OF THE EMBODIMENT

Figure 1:
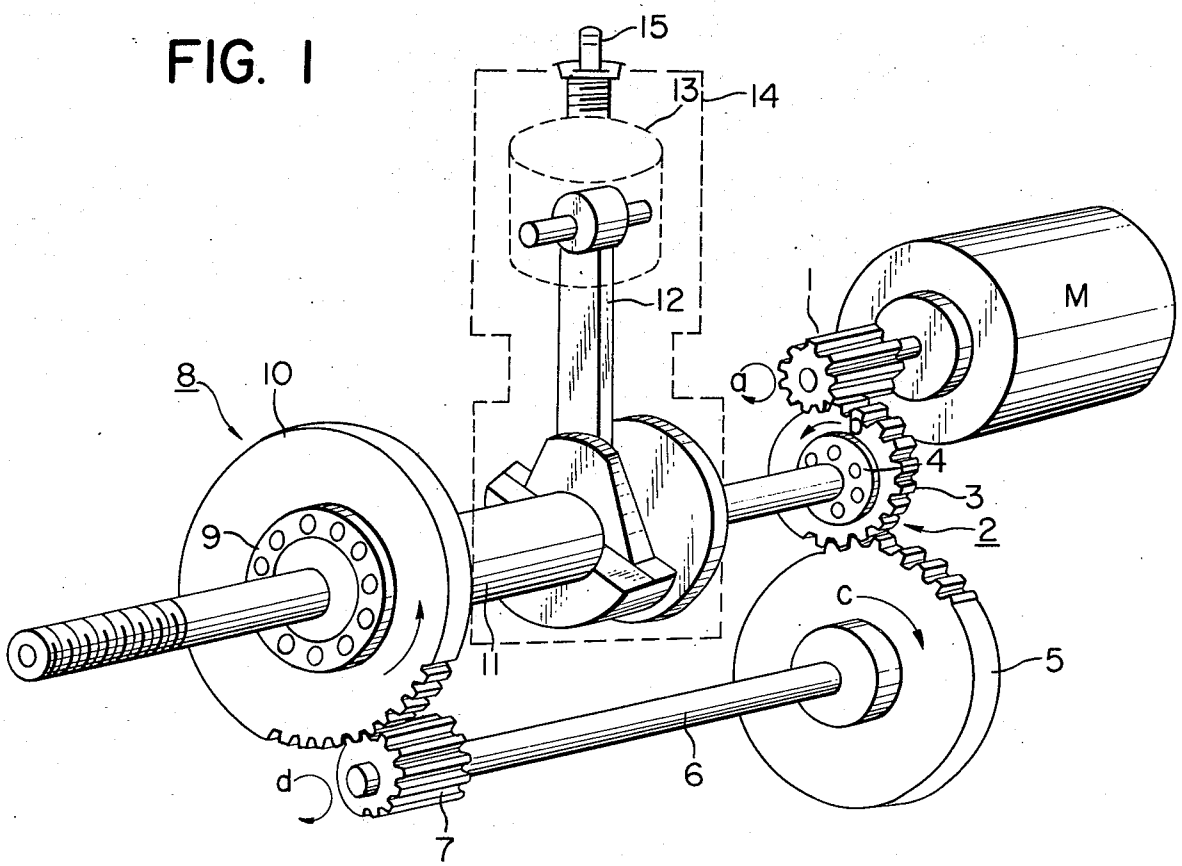
FIG. 1 is a perspective view of the essential parts of an embodiment of this invention.

In FIG. 1, symbol M refers to a d-c magnet motor used in this invention; numeral 1 to a first pinion gear fixed to the rotating shaft of the motor M; 2 to a first clutch and gear assembly; 3 to a first drive gear; 4 to a first clutch; 5 to an intermediate gear; 6 to a drive shaft; 7 to a second pinion gear; 8 to a second clutch and gear assembly; 9 to a second clutch; 10 to a second drive gear; 11 to a crankshaft; 12 to a crank; 13 to a piston; 14 to an engine; and 15 to a spark plug, respectively.

The first clutch and gear assembly is composed of the first drive gear and the electromagnetically driven first clutch capable of transmitting revolution to the drive gear 3 in only one direction. The intermediate gear 5 is fitted to an end of the drive shaft 6 and in mesh with the first drive gear 3. On the other end of the drive shaft 6, provided is the second pinion gear 7 which is in mesh with the second drive gear 10 of the second clutch and gear assembly 8. The second clutch and gear assembly 8 has the electromagnetically driven second clutch 9 capable of transmitting revolution to the second drive gear 10 and the crankshaft 11 in only one direction, and fitted to an end of the crankshaft 11. The crank 12 is fitted to the other end of the crankshaft 11. The piston 13 is provided on the other end of the crank 12. The piston 13 is driven by the engine 14 in which the spark plug 15 is provided.

Figure 2:
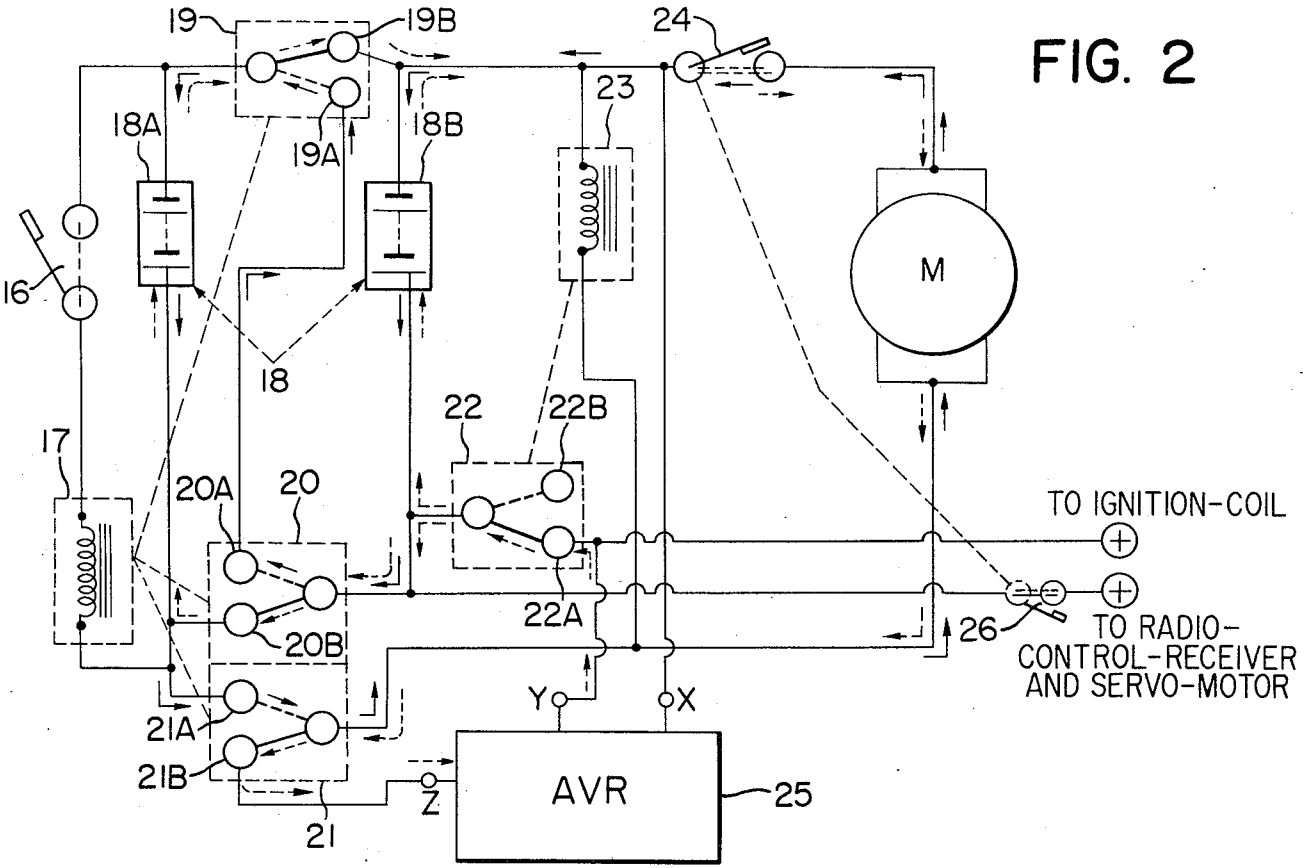
FIG. 2 is a diagram of an electric circuit for changing over motor/dynamo functions, which embodies this invention.

In FIG. 2, numeral 16 refers to a starter switch; 17 to a first relay; 18 to a battery consisting of two cells 18A and 18B of Ni-Cd (nickel cadmium) battery, for example; 19, 20, 21 and 22 to changeover switches having contacts 19A, 19B, 20A, 20B, 21A, 21B, 22A and 22B, respectively; 23 to a second relay for holding contacts; 24 to a main switch; 25 to a voltage regulator having input/output terminals X, Y and Z for regulating load voltage and regulating the generated voltage so as to permit the battery 18 to be charged even at low engine revolutions; 26 to a switch, respectively.

When starting the engine 14, the starter switch 16 in FIG. 2 is first turned on. This actuates the first relay 17 to switch over the changeover switches 19, 20 and 21 to make the contacts 19A, 20A and 21A. In this state, closing the main switch 24 causes current to flow in a circuit composed of the battery cell 18B, the contact 20A, the contact 19A, the battery cell 18A, the contact 21A, the motor M, the main switch 24 and the battery cell 18B, as shown by a solid line in the figure. The motor M is caused to rotate as a motor by the series-connected battery cells 18A and 18B. Then the rotating shaft of the motor M and the first pinion gear shown in FIG. 1 rotate in the direction shown by an arrow a. This revolution is transmitted to the intermediate gear 5 via the first drive gear 3 in the direction shown by an arrow c for speed reduction. The revolution of the intermediate gear 5 is then transmitted to the second pinion gear 7 via the drive shaft 6 (in the direction d) for further speed reduction by the second drive gear 10. In this state, the first clutch 4 provided in the first clutch and gear assembly 2 is disengaged while the second clutch 9 provided on the second clutch and gear assembly 8 is engaged. As a result, the crankshaft 11 is caused to rotate in the direction shown by an arrow e, the same direction as the second drive gear 10, reciprocating the crank 12 and the piston 13. In this state where the first clutch 4 remains disengaged, the crankshaft 11 is released from the first drive gear 3 so that the revolution of the first drive gear 3 is not transmitted directly to the crankshaft 11.

Meanwhile, in FIG. 2, the second relay 23 is actuated to change over the changeover switch 22 to make the contact 22A, causing current to flow in an ignition coil (not shown), which in turn ignites the spark plug 15 in accordance with the reciprocating motion of the piston 13 to start the engine 14. The second relay 23 holds the closed state of the contact 22A of the changeover switch 22 until the voltage drops to approx. 2 volts, for example, permitting the current to continue flowing in the ignition coil. The power of the battery 18 is fed to a radio control receiver and a servo motor via the switch 26 interlocked with the main switch 24.

After the engine has been started, the starter switch 16 in FIG. 2 is turned off, causing the first relay 17 to turn off, changing over the changeover switches 19, 20 and 21 to the side of the contacts 19B, 20B and 21B, respectively. As a result, the battery cells 18A and 18B are connected in parallel by the contacts 19B and 20B, and charged through a charging circuit consisting of the motor M now serving as a generator, the contact 21B, the point Z, the regulator 25, the point Y, the contact 22A, the battery 18 and the main switch 24.

In this state, the first clutch 4 in FIG. 1 is engaged while the second clutch 9 is disengaged. This causes the revolution of the engine 14 to be transmitted to the first pinion gear 1 via the crank 12, the crankshaft 11, the first clutch 4 and the first drive gear 3. This transmission arrangement substantially reduces the load to the engine 14, compared with the previous transmission arrangement in which the motor M is driven through the drive shaft 6. In this charging mode, the second relay 23 is kept in operation and the ignition coil and the radio control receiver remain energized as the contact 22A is kept closed. The voltage regulator 25 regulates the load voltage across the points X and Y. That is, the voltage regulator 25 is designed to supply current only in a direction from the point Z to the point Y is the figure so as to permit the battery cells 18A and 18B to be charged even at very low engine revolutions when the motor M is operated as a generator. This tends to increase the terminal voltage of the generator to an excessively high value when the engine 14 is in a high-speed operation. The voltage regulator 25, however, controls what may be called the series resistance value across the points Z and Y, for example, the amount of conduction or conduction time of transistors, so as to maintain the voltage on the load side at a level slightly higher than 5 V, for example, irrespective of the revolution of the engine 14, just as a well-known automatic voltage regulator does.

Based on the test results, a voltage of 10 V obtained by series connecting two sets of four 1.25-V Ni-Cd battery cells is used to drive the motor M, and the engine 14 is started by reducing the revolution of the motor M to 1/9. With this arrangement, the engine 14 is started with a sufficiently high torque. However, if this transmission arrangement is left unchanged even after the engine 14 has been put into operation, the revolution of the motor M is increased to 9 times that of the engine 14, resulting in too high a load to the engine to continue flight in a model airplane. To overcome this problem, therefore, the output loss (approx. 10%) of the engine is reduced to a level not substantially affecting the flight performance of the model airplane by driving the motor M through the first clutch 4 to reduce the speed increment of the motor M to approx. 2.5 times the engine speed. That is, at engine revolutions of 4,000 to 11,000 rpm, the motor M as a dynamo is driven at a speed 2.5 times as high as that of the engine. At this speed, the motor M as a dynamo generates a power of 2A, approx. 10 V, which is regulated by the voltage regulator 25 to a level slightly higher than 5 V to charge the battery 18. In other words, this invention makes it possible to obtain a high output required for starting the engine and to charge the battery while minimizing the load to the engine during the operation of the engine, using the motor M of the smallest possible size.

Figure 3:
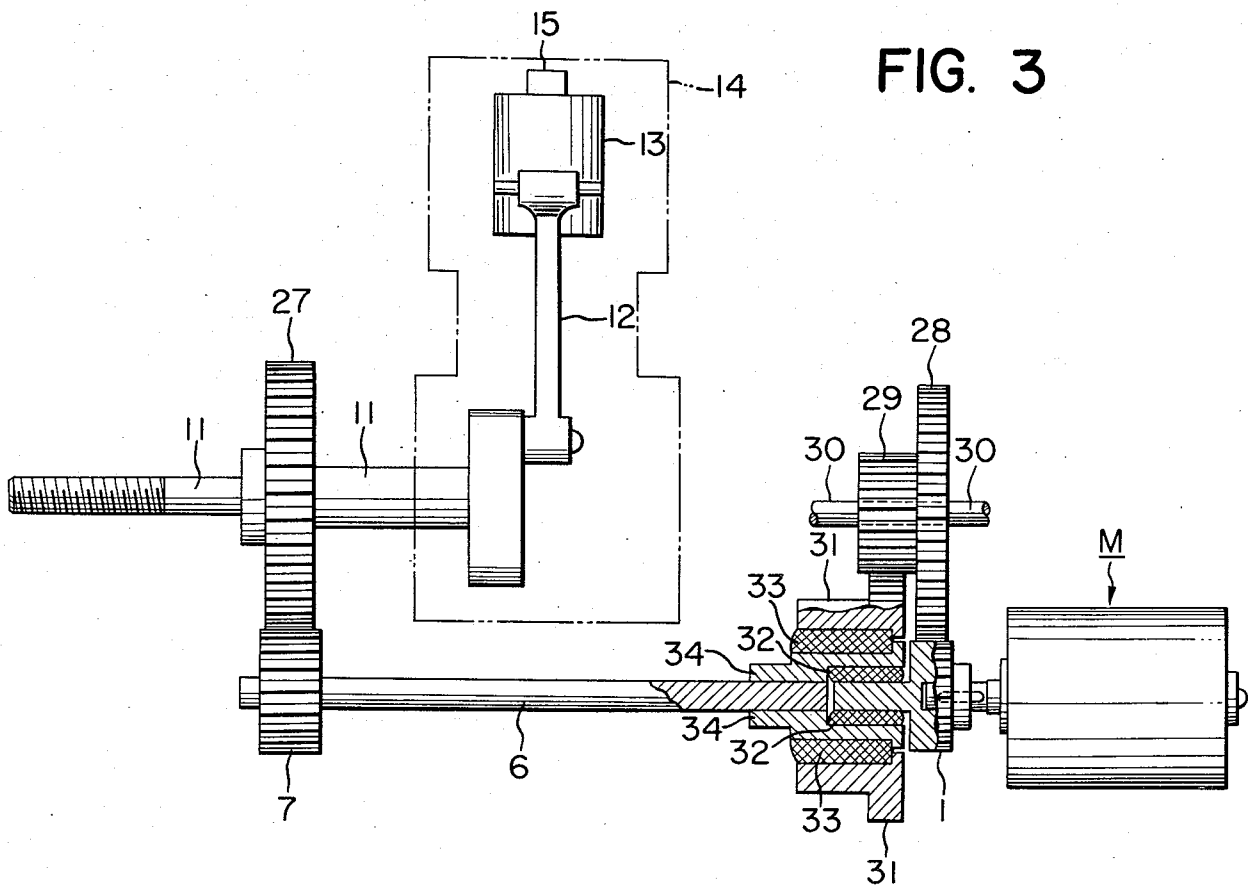
FIG. 3 is a side elevation, partly cross-sectional, of the essential parts of another embodiment of this invention.

FIG. 3 is a schematic side elevation, partly cross-sectional, of the essential parts of another embodiment of this invention. Symbol M and numerals 1, 6, 7 and 11 through 15 in the figure correspond with like symbol and numerals in FIGS. 1 and 2. Numeral 27 refers to a main gear; 28 to a first intermediate gear (A); 29 to a first intermediate gear (B); 30 to a gear shaft rotatably supported by bearings (not shown), to which the first intermediate gears 28 and 29 are fixed; 31 to a second intermediate gear; 32 to a first electromagnetic clutch; 33 to a second electromagnetic clutch; 34 to a bushing which is fitted in between the first and second electromagnetic clutches 32 and 33 and fixed to the drive shaft 6, respectively.

The cross-sectional part in FIG. 3 illustrates those parts relating to the first and second electromagnetic clutches 32 and 33. The first electromagnetic clutch 32 is used for coupling the first pinion gear fixed to the motor rotational shaft with the bushing 34 fixed to the drive shaft 6. That is, when the first electromagnetic clutch 32 is turned on, the motor rotational shaft is coupled with the drive shaft 6. The second electromagnetic clutch 33 is used for coupling the bushing 34 with the second intermediate gear 31. Turning on the second electromagnetic clutch 33 causes the drive shaft 6 to be coupled with the motor rotational shaft via the bushing 34, the second intermediate gear 31, the first intermediate gears 29 and 28, and the first pinion gear 1.

When starting the engine 14 in FIG. 3, the motor M is caused to rotate, receiving the power of the battery 18 consisting of the series-connected battery cells 18A and 18B, as described referring to FIG. 2, after turning off the first electromagnetic clutch 32 and turning on the second electromagnetic clutch 33. The revolution of the rotational shaft 27 of the motor M is transmitted to the drive shaft 6 after the speed thereof is reduced in a transmission train consisting of the first pinion gear 1, the first intermediate gears 28 and 29, the second intermediate gear 31, the second electromagnetic clutch 33 and the bushing 34. The drive shaft 6 then causes the crankshaft 11 to rotate via the second pinion gear 7 and the main gear 27. The revolution of the crankshaft 11 causes the crank 12 to reciprocate to drive the piston 13. As the spark plug 15 is caused to ignite in accordance wih the reciprocating motion of the piston 13, the engine 14 is started and put into motion. Although starting the engine 14 requires a large torque, a relatively small sized and low output electric motor can be used as the motor M since the revolution of the motor M is transmitted, after being reduced in several stages (three stages in the embodiment shown in FIG. 3), to the crankshaft 11. This contributes much to the weight reduction of the engine-driven model toy.

As described above, once the engine 14 has been started by the motor M and put into steadystate operation, a part of the revolution of the engine 14 is transmitted in the reversed direction through the transmission path used for starting the engine 14, except for a part thereof, to operate the motor M as a generator. When charging the battery 18 shown in FIG. 2, the motor M is driven by the engine 14 in the following manner. That is, in a state where the first electromagnetic clutch 32 is turned on and the second electromagnetic clutch 33 is turned off, the revolution of the crankshaft 17 of the engine 14 is transmitted to the drive shaft 11 through the main gear 27 and the second pinion gear 7. The drive shaft 6 then causes the motor M to rotate through the bushing 34, the first electromagnetic clutch 32 and the first pinion gear 1. As the second electromagnetic clutch 33 is kept in the OFF state, the bushing 34 is kept disengaged with the second intermediate gear 31, whereby the revolution of the drive shaft 6 is not transmitted to the second intermediate gear 31. Consequently, the revolution of the drive shaft 6 is transmitted to the motor M as it is. In this state, furthermore, the revolution of the motor M is much lower than in the case where the revolution of the drive shaft 6 is transmitted to the motor M through the very reverse of the transmission path from the motor M to the drive shaft 6 as used for starting the engine 14. This helps to reduce the load required for the engine 14 to charge the battery 18.

In this invention, the first electromagnetic clutch 32 and the second electromagnetic clutch 33 for shifting the revolution transmission between the motor M and the drive shaft 6 at engine starting and during battery charging are arranged coaxially, as shown in FIG. 3. This arrangement permits the use of a single output shaft of the engine 14, that is, the crankshaft 11 alone since the shifting of revolution transmission can be accomplished between the motor M and the drive shaft 6 to which the revolution of the engine 14 is transmitted through the crankshaft 11, the main gear 27 and the second pinion gear 7.

In the foregoing, description has been made mainly on a model airplane. It is needless to say that this invention has similar effects in other self-propelled model toys such as an engine-driven model car, a model ship, etc. The use of 1-way clutches is preferred as the aforementioned electromagnetic clutches, but clutches other than electromagnetic types may be used.

As described above, this invention relating to an engine-driven model toy having an engine with a limited output, a small electric motor connected to the engine and a power source battery makes it possible to start the engine by operating the motor as a high output motor and charging the battery during the steadystate operation of the engine by operating the motor as a dynamo while reducing the load to the engine by coupling the engine with the motor by the use of a transmission mechanism capable of changing over the speed ratio of the engine and motor to predetermined values using two clutches in accordance with the respective operating modes of the motor. This invention also makes it possible to change over the speed ratio of the engine and the motor in accordance with the operating modes of the motor, i.e., at starting the engine and during battery charging even with an engine of the single output shaft type. Consequently, with the aforementioned transmission mechansim, which enables the use of a commercially available single output shaft type engine, manufacturing costs can be substantially saved.

Furthermore, the aforementioned arrangement enables both starting the engine and charging the battery merely by turning on and off a switch. As a result, hand injuries caused during manual starting of the engine by hand can be prevented and the need for separately providing a starter motor or a charging battery can be eliminated. Furthermore, the use of a Ni-Cd battery makes it possible to drive the motor M with high output during engine starting and to reduce the overall weight of the model toy. Because of rechargeability of Ni-Cd battery, the engine can be started and stopped at any time and in an appropriate manner, and the difficulty of engine starting due to the overdischarge of the battery can be eliminated.

Moreover, the aforementioned power source battery can be used in common for the radio control receiver, enabling the control of the model toy for a much longer time using an automatic stablilizer (gyroscope), servomotor, etc., compared with conventional radio-controlled model toys, eliminating the possible failure of control due to the overdischarge of the power source for radio control receiver, resulting in improved stability and safety.

What is claimed is:

1. An engine-driven model toy airplane flown by at least one propeller and having an engine drivingly coupled to said propeller, an electric motor connected to said engine and a power source battery, and characterized in that said engine is connected to said electric motor by means of a transmission mechanism capable of changing the ratio of revolution between said engine and said electric motor to predetermined values as required, respectively, by the starting and continuous operation modes of said engine, and in that said electric motor is capable of starting said engine by receiving the power of said battery at the starting mode of operation of said engine, and charging said battery during the continuous mode of operation of said engine by receiving the revolution of said engine to operate as a dynamo.

2. An engine-driven model toy as set forth in claim 1 characterized in that said transmisson mechanism comprises a drive shaft connected to a crankshaft of said engine through gears, and first and second clutches for selectively connecting and disconnecting said drive shaft and said electric motor; said engine being driven by said electric motor at a first gear ratio during the engine starting mode of operation by turning off said first clutch and turning on said second clutch, and during the continuous mode of operation of said engine, said electric motor is driven by said engine at a second gear ratio by turning on said first clutch and turning off said second clutch.

3. An engine-driven model toy as set forth in claim 2 characterized in that said motor rotational shaft is connected to an end of said crankshaft through a first clutch and gear assemby and to an end of said drive shaft through gears; the other end of said drive shaft being connected to the other end of said crank-shaft through a second clutch and gear assembly; so as to permit said first clutch to transmit the revolution of said crankshaft, after increasing the speed thereof; to said motor rotational shaft only in the direction from a crank to the motor, and permit said second clutch to transmit the revolution of said motor, after decreasing the speed thereof, to said crankshaft only in the direction from said drive shaft to said crank.

4. An engine-driven model toy as set forth in claim 3 characterized in that said transmission mechanism comprises a pinion gear fixed to said motor rotational shaft and connected to a bushing that is fixed to said drive shaft by means of said first clutch; said bushing being connected to a reduction gear connected to said pinion gear by means of said second clutch; and said drive shaft is connected to said crankshaft by means of gears so as to permit said first clutch to transmit the revolution of said drive shaft to said motor rotational shaft only in the direction from said drive shaft to said motor shaft, and permit said second clutch to transmit the revolution of said motor rotational shaft, after reducing the speed thereof, to said drive shaft only in the direction from said reduction gear to said drive shaft.

5. An engine-driven model toy as set forth in claim 1 characterized in that an electrical circuit for connecting said electric motor to said power source battery which comprises a plurality of battery cells has a changeover mechanism capable of connecting said plurality of battery cells in series at the engine starting mode of operation and connecting said plurality of battery cells in parallel during the continuous mode of operation of said engine.

6. An engine-driven model toy as set forth in claim 5 characterized in that said electrical circuit for connecting said electrical motor to said power source battery has an automatic voltage regulator and is constructed so that the voltage for charging said power source battery during the continuous mode of operation of said engine is maintained by said automatic voltage regulator at a predetermined voltage value.

7. An engine-driven model toy as set forth in claim 6 characterized in that said electric motor, at the engine starting mode of operation, is adapted to start said engine by receiving the power of said plurality of battery cells connected in series by said changeover mechanism of said electrical circuit, with a speed reduced by said transmission mechanism; and during the continous mode of operation of said engine, said electric motor is caused to rotate by the revolution of said engine with a speed increased by said transmission mechanism to a higher level than that of said engine to charge said plurality of battery cells connected in parallel by said changeover mechanism at a predetermined charging voltage regulated by said automatic voltage regulator.

8. An engine in combination with a model toy airplane, said toy further comprising an electric motor connected to said engine and a power source battery means defined by a plurality of battery cells, said engine being connected to said electric motor by means of a transmission mechanism capable of changing the ratio of revolution between said engine and said electric motor to predetermined values as required, respectively, by the starting operation mode of said engine and the continuous operation mode of said engine, there being further included an electrical circuit for connecting said electric motor to said power source battery and wherein said electrical circuit has a changeover mechanism capable of connecting said plurality of battery cells in series at the engine starting mode of operation and connecting said plurality of battery cells in parallel during the continuous operation mode of said engine, said electric motor at the engine starting mode of operation being adapted to start said engine by receiving the power of said plurality of battery cells connected in series by said changeover mechanism of the battery connecting circuit, with a speed reduced by said transmission mechanism; and during the continuous mode of operation of said engine, the electric motor is caused to rotate by the revolution of said engine with a speed that is increased by said transmission mechanism to a higher level than that of said engine to charge said plurality of battery cells connected in parallel by the changeover mechanism at a predetermined charging voltage, there being further included an automatic voltage regulator for regulating the predetermined charging voltage.

9. An engine-driven model toy as set forth in claim 8 characterized in that said transmission mechanism comprises a drive shaft connected to a crankshaft of said engine through gears, and first and second clutches for selectively connecting and disconnecting said drive shaft and said electric motor; said engine being driven by said electric motor at a first gear ratio during the engine starting mode of operation by turning off said first clutch and turning on said second clutch, and during the continuous mode of operation of said engine, said electric motor is driven by said engine at a second gear ratio by turning on said first clutch and turning off said second clutch.

10. An engine-driven model toy as set forth in claim 9 characterized in that said motor rotational shaft is connected to an end of said crankshaft through a first clutch and gear assembly and to an end of said drive shaft through gears; the other end of said drive shaft being connected to the other end of said crank-shaft through a second clutch and gear assembly; so as to permit said first clutch to transmit the revolution of said crankshaft, after increasing the speed thereof, to said motor rotational shaft only in the direction from said crank to said motor, and permit said second clutch to transmit the revolution of said motor, after decreasing the seed thereof, to said crankshaft only in the direction from said drive shaft to said crank.

11. An engine-driven model toy as set forth in claim 10 characterized in that said transmission mechanism comprises a pinion gear fixed to said motor rotational shaft and connected to a bushing that is fixed to said drive shaft by means of said first clutch; said bushing being connected to a reduction gear connected to said pinion gear by means of said second clutch; and said drive shaft is connected to said crankshaft by means of gears so as to permit said first clutch to transmit the revolution of said drive shaft to said motor rotational shaft only in the direction from said drive shaft to said motor shaft, and permit said second clutch to transmit the revolution of said motor rotational shaft, after reducing the speed thereof, to said drive shaft only in the direction from said reduction gear to said drive shaft.

* * * * *